United States Patent [19]

Glasener

[11] 4,305,628

[45] Dec. 15, 1981

[54] PILFER-PROOF DISPENSING CABINET

[75] Inventor: Kenneth A. Glasener, Golf, Ill.

[73] Assignee: Dynagraphic Merchandising Corp., Chicago, Ill.

[21] Appl. No.: 210,045

[22] Filed: Nov. 24, 1980

Related U.S. Application Data

[63] Continuation of Ser. No. 7,335, Jan. 29, 1979.

[51] Int. Cl.[3] ..... A47F 1/00; B65D 60/00; B65G 59/00

[52] U.S. Cl. ..... 312/42; 312/60; 312/61; 312/118; 206/44.12; 206/815; 221/133; 221/281

[58] Field of Search ..... 312/42, 35, 60, 61, 312/118, 108; 221/281, 133, 92; 206/44.12, 815

[56] References Cited

U.S. PATENT DOCUMENTS

| | | | |
|---|---|---|---|
| 792,923 | 6/1905 | Porter | 221/133 |
| 821,573 | 5/1906 | Allison | 312/42 |
| 1,505,725 | 8/1924 | Obradovits | 221/281 |
| 1,507,999 | 9/1924 | Hubbard | 221/281 |
| 1,611,742 | 12/1926 | Hammer | 312/118 |
| 1,624,883 | 4/1927 | Allen | 221/281 |
| 1,865,895 | 7/1932 | Fry | 312/35 |
| 1,938,815 | 12/1933 | Grenier | 312/35 |
| 2,027,645 | 1/1936 | Marx | 206/44.12 |
| 2,044,288 | 6/1936 | Fry | 312/118 |
| 3,263,860 | 8/1966 | Haas | 221/281 |
| 3,851,938 | 12/1974 | McCowan et al. | 312/108 |
| 4,037,756 | 7/1977 | Jaquish | 312/42 |

FOREIGN PATENT DOCUMENTS

| | | | |
|---|---|---|---|
| 955557 | 4/1964 | United Kingdom | 312/42 |
| 1314152 | 4/1973 | United Kingdom | 312/42 |

*Primary Examiner*—Victor N. Sakran
*Attorney, Agent, or Firm*—Norman Lettvin

[57] ABSTRACT

A cabinet for manually dispensing various brands of cigarettes or other packaged product wherein each package is stacked in individual compartments and dispensed from the rear of the cabinet to the front thereof by using a finger of the dispenser.

4 Claims, 7 Drawing Figures

PILFER-PROOF DISPENSING CABINET

This is a continuation of application Ser. No. 007,335, filed Jan. 29, 1979.

SUMMARY OF THE INVENTION

An enclosed cabinet having a rear door; a series of compartments in side-by-side arrangement including a front wall and a shelf wherein each compartment is stacked with a different packaged product; a forwardly extending, pilfer-proof barrier area at the front of the machine in which individual packages are to be received by the purchaser; and notches in the rear door through which the dispenser may insert his finger to push a desired package to the receiving area.

DETAILED DESCRIPTION OF THE DRAWINGS

Figure 1:
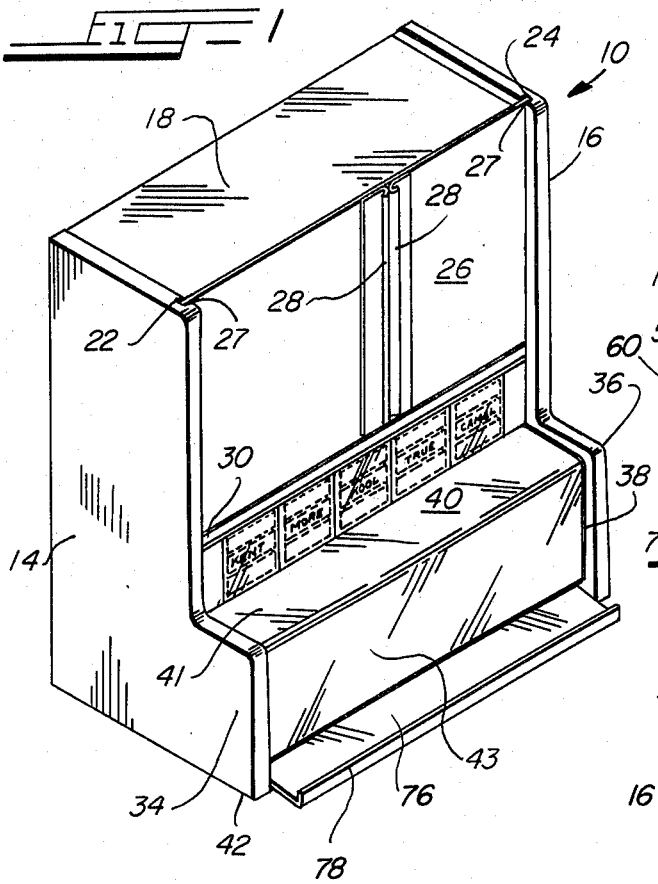
FIG. 1 is a perspective view of the dispensing cabinet.
Figure 3:
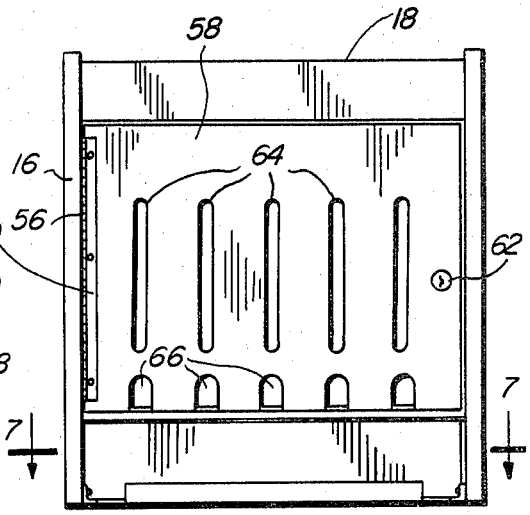
FIG. 3 is a rear elevational view of the back of the cabinet.
Figure 7:
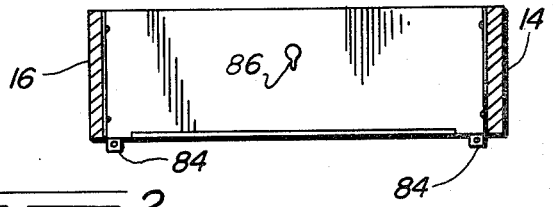
FIG. 7 is a cross-sectional view taken on the lines 7—7 of FIG. 3.
Figure 2:
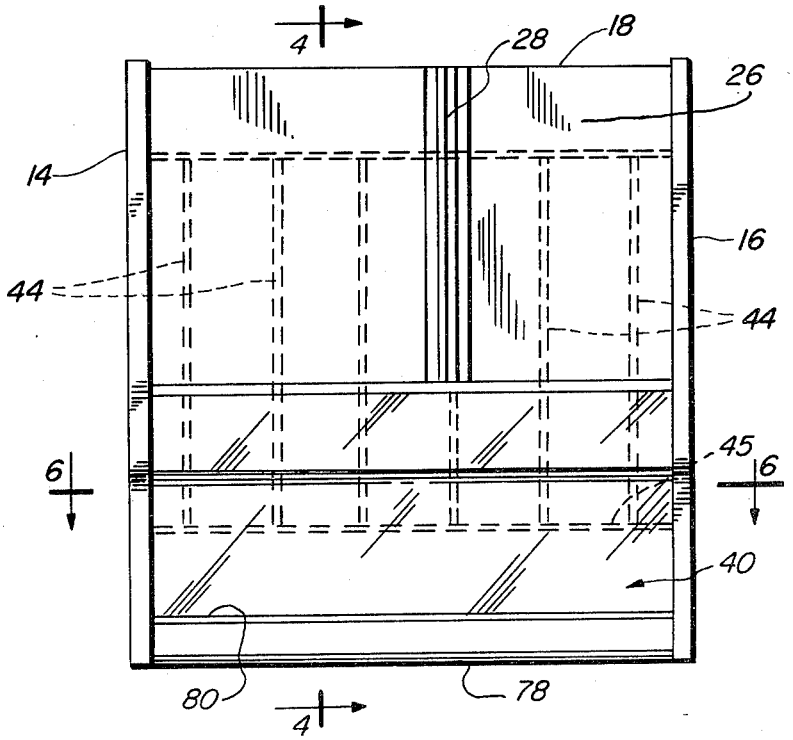
FIG. 2 is a front elevational view of the cabinet.

The cabinet 10 is provided with vertically extending front wall 12 and side walls 14, 16, horizontally disposed top wall 18, and a bottom wall 20, all anchored together. The side walls 14, 16 are each provided with grooves 22, 24, respectively, with a bottomed well above the lower ends of the side walls to seat a metal face panel 26 having a pair of vertical grooves 28 formed therein. The face panel 26 has the peripheral side and bottom edges bent back upon itself to form grooves 27. Advertising panels, not shown, are slidingly positioned between the grooves 27 and 28. The advertising panel is supported at the bottom by the lower groove 30.

An elongated, clear plastic panel 32 is also anchored in and between grooves 22, 24 and positioned below the face panel 26. This panel 32 has grooves in its long edges for the reception of identification of various packaged products such as, for instance, brands of cigarettes and these may readily be changed by the dispenser.

The side walls 14, 16 have offset portions 34, 36 extending forwardly of the front wall 12. Each offset 34, 36 is provided with opposed grooves 38 to seat the ends of a clear plastic barrier 40. The grooves 38 are bottomed out a short distance from the lower end of the offset bottom walls 42 and the upper end just below and inwardly of the front wall 12. The barrier comprises a one piece, horizontal wall 41 and a vertical wall 43. The pilfer-proof barrier is so constructed that a person cannot reach interiorly thereof.

The area immediately behind the front wall 18 is provided with a series of compartments for various packaged products, such as brands of cigarettes. These rows are formed by spaced vertical divider plates 44 anchored to the compartment top wall 39 and a shelf 45. The divider plates 44 are spaced enough apart so that a supply of packages may be stacked therein vertically with the individual packages positioned therein lying flat, i.e., on their long faces. The bottom packages rest on the shelf 45. The shelf 45 extends between the side walls 14, 16 and in grooves 46 in the side walls. The divider walls 44 are each bent at right angles as at 48 on their lower ends to be anchored to the upper surface of shelf 45.

Figure 4:
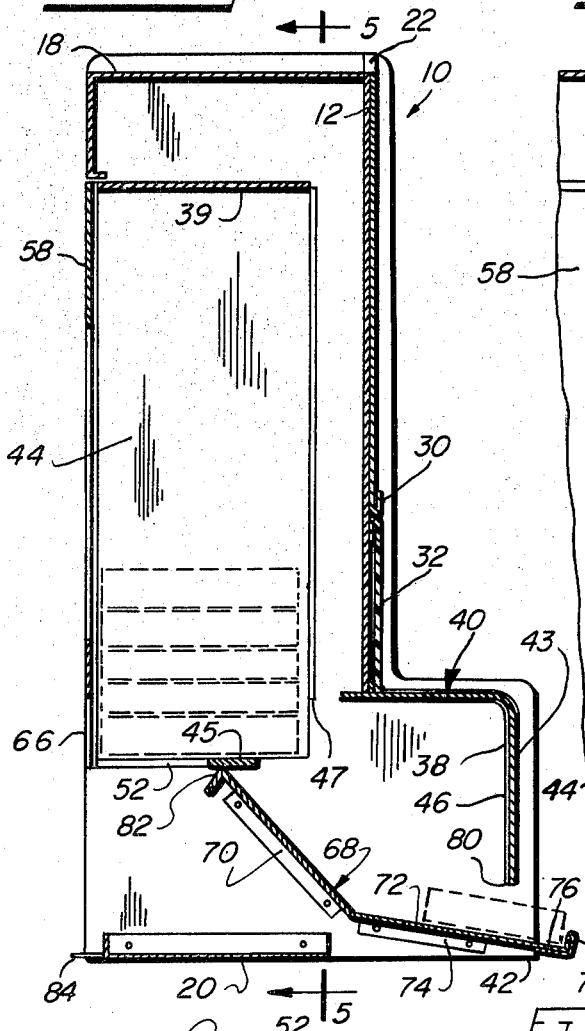
FIG. 4 is a cross-sectional view taken on the lines 4—4 of FIG. 2.
Figure 5:
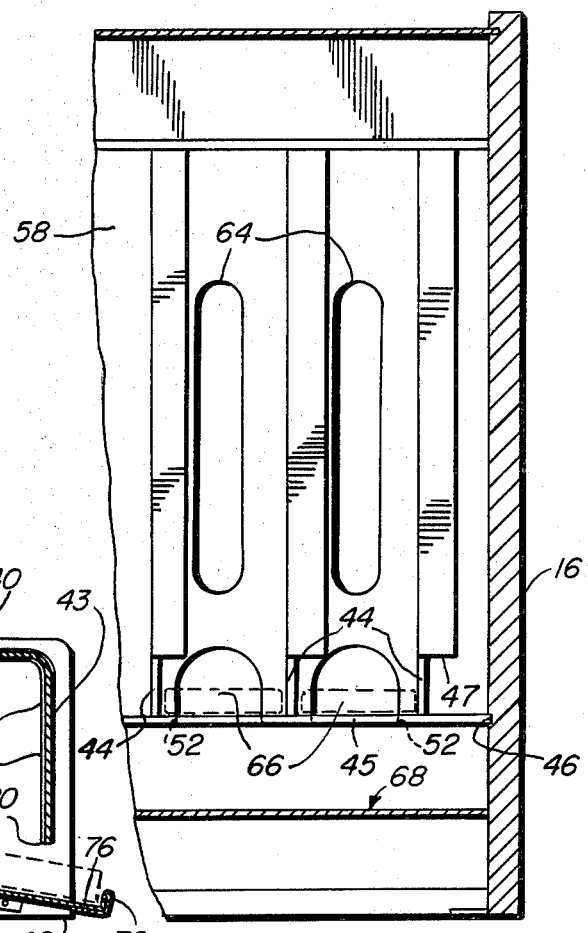
FIG. 5 is a cross-sectional view taken on the lines 5—5 of FIG. 4 with parts broken away.
Figure 6:
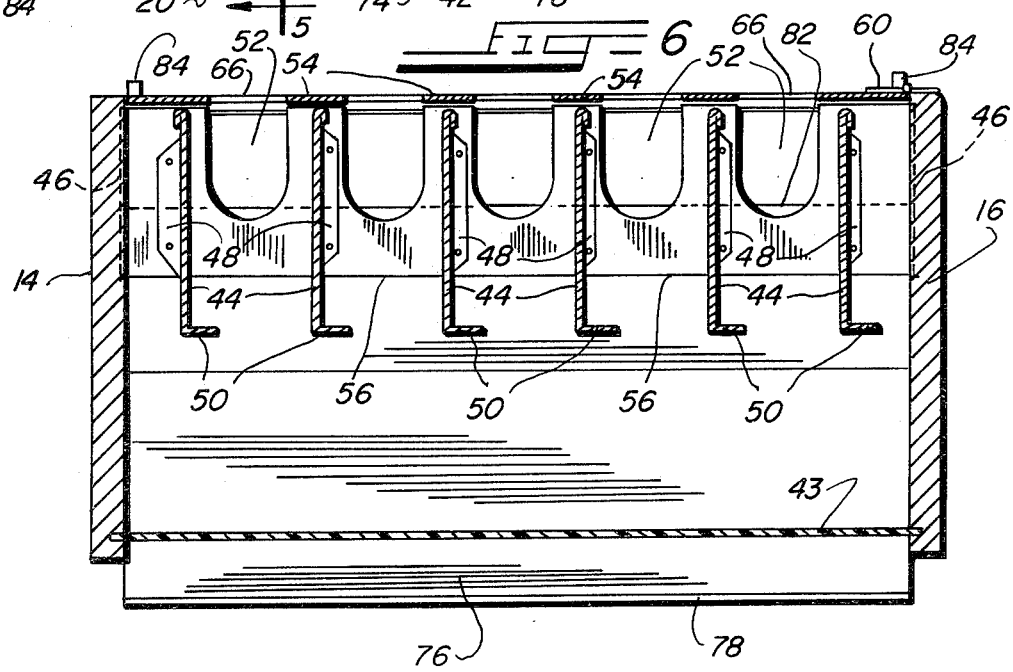
FIG. 6 is a cross-sectional view taken on the lines 6—6 of FIG. 2.

Each divider plate 44 is also provided with a right angle bend 50 on its front edge with the lower end terminating above the shelf 45. The width of the shelf 45 is less than the width of the divider plates, as seen in FIG. 4, and the right angle bend 50 acts as an abutment for the stack of products, as well as to prevent more than one package of product being dispensed at a time from the stack. It is to be noted that the upper end 47 of the barrier lies adjacent the lower end of the front wall 12 and rearward thereof. (See FIG. 4.)

The shelf 45 is provided with U-shaped openings 52 extending from the rear edge 54 inwardly a substantial distance but not to the front edge 56 to lighten the structure.

A door 58 is hinged, as at 60, to the side wall 16 and has a lock 62 on the opposite side which latches to the side wall 14 to prevent unauthorized access to the interior of the cabinet.

The door 58 is provided with a series of slots 64 whereby the dispenser can view the interior of the rows of packages to make certain they are full of various brands. Also, the lower end of the door is provided with a series of wide, U-shaped cutouts 66 lined with each compartment, the purpose of which will hereinafter be explained.

A portion of a one-piece slide or delivery plate 68 extends between the side walls 14, 16 and extends downwardly and forwardly at a relatively steep angle, as shown in FIG. 4. A portion of the sides of the plate 68 is bent downwardly at right angles as at 70 and anchored to the inside of the side walls 14, 16. The forward or lower end delivery plate 68 is at a great deal lesser angle as at 72 and the sides thereof are provided with right angle bend 74 at each end 34, 36 to be anchored also to the inside of side walls of the offset portions 34, 36. The end 76 of the side plate 68 extends outwardly of and below the lower end 80 of the clear plastic barrier 40 and terminates in an upturned rim 78. (See FIGS. 1 and 4.) It is to be noted the lower edge 80 of the vertical wall 43 of the pilfer-proof barrier 40 terminates above the dispenser plate 68 and is rearward of the rim 78 whereby a package can be picked up by the purchaser. The upper end 82 of the angular plate 68 extends below the lower side of the shelf 45, as seen in FIG. 4.

The bottom wall 20 may be used to store match packs or the like thereon. The wall 20 has a pair of extensions 84 containing a perforation therein for anchoring the unit to the counter, as well as a keyhole slot 86.

In operation, after the vertical rows are filled with packages, if a customer requests a certain brand, the person dispensing the packages would merely insert his forefinger in the respective U-shaped opening 66 and push forward the lowermost package on shelf 45 towards the vertical wall 43 of the barrier or to the front of the cabinet and the package would slide down the inclined pathway on slideway 68 where it will slide forwardly until it reaches the stop 78 formed by the upturned rim. From thence, the customer removes the package.

The drawings show, for illustration, the cabinet used for dispensing cigarettes, but it will be understood that other packaged products may be dispensed from the cabinet.

Although but one specific embodiment of this invention is herein shown and described, it will be understood that details of the construction shown may be altered or omitted without departing from the spirit of the invention as defined by the following claims.

I claim:

1. In a cabinet for storing and displaying prepackaged articles and for dispensing prepackaged articles therefrom, the cabinet having spaced back and front sides adapted, respectively, to be positioned on a counter between two persons, one of said persons being in position to receive a dispensed prepackaged article from the front side of the cabinet and the other person being in position to manually dispense a selected prepackaged article from the cabinet only in a direction toward said one person adjacent the front side of the cabinet; the improvement comprising, in combination:

the cabinet being of a width to define therein a plurality of adjacent, vertically elongated, package storage compartments, each of a size to receive therein a stack of a plurality of substantially identically sized prepackaged articles; each compartment being bounded at its lower end by a laterally elongated support shelf that serves as a common lower boundary for the plurality of compartments;

the cabinet being constructed to provide a pilferproof front wall means having therein a laterally elongated front opening of limited height through which a portion of a dispensed article extends so that it may be removed from said cabinet by said one person; inclined discharge chute means of substantially the same lateral extent as the laterally elongated support shelf, said chute positioned in said cabinet below and forwardly of said support shelf for receiving discharged articles from any one of said plurality of compartments and for delivering such discharged articles forwardly, under gravity, to adjacent said opening in said front wall means;

the support shelf being spaced above the upper extent of said laterally elongated opening in the front wall means, so as to frustrate said one person from manually reaching articles on said support shelf through said opening in the front wall means of the cabinet;

said cabinet having rear wall means with a series of apertures therein located adjacent to and immediately above the support shelf, the edge of said shelf adjacent said rear wall apertures including a series of shelf apertures therein with each shelf aperture positioned adjacent to and cooperating with one of said rear wall apertures; and one aperture of said series of rear wall apertures and one aperture of said series of shelf apertures being associated with each vertically elongated compartment, each of said rear wall apertures being sized, shaped and located such that said other person, by insertion of his finger forwardly through said aperture, will dispense only the lowest item of each stack of prepackaged articles forwardly past the forward edge of the support shelf to fall onto said discharge chute means.

2. A construction as in claim 1, wherein the discharge chute means extends forwardly a distance sufficient to project through said laterally elongated front opening.

3. A construction as in claim 1, that includes an upright divider plate adjacent each vertically elongated compartment, the width of the divider plate, extending forwardly, being greater than the width of said support shelf, each divider plate having adjacent its forward edge a flange that extends transversely to the divider plate and acts as a forward abutment for the stack of products in the vertically elongated compartment, the height of said flange that acts as a forward abutment terminating spaced above the plane of the support shelf to prevent more than one package of product being dispensed at a time from the stack.

4. In a cabinet for storing and displaying prepackaged articles and for dispensing prepackaged articles therefrom, the cabinet having spaced back and front sides adapted, respectively, to be positioned on a counter between two persons, one of said persons being in position to receive a dispensed prepackaged article from the front side of the cabinet and the other person being in position to manually dispense a selected prepackaged article from the cabinet only in a direction toward said one person adjacent the front side of the cabinet; the improvement comprising, in combination:

the cabinet being of a width to define therein a plurality of adjacent, vertically elongated, package storage compartments, each of a size to receive therein a stack of a plurality of substantially identically sized prepackaged articles; each compartment being bounded at its lower end by a laterally elongated support shelf that serves as a common lower boundary for the plurality of compartments;

the cabinet being constructed to provide a pilferproof front wall means having therein a laterally elongated front opening of limited height through which a portion of a dispensed article extends so that it may be removed from said cabinet by said one person; inclined discharge chute means of substantially the same lateral extent as the laterally elongated support shelf, said chute positioned in said cabinet below and forwardly of said support shelf for receiving discharged articles from any one of said plurality of compartments and for delivering such discharged articles forwardly, under gravity, to adjacent said opening in said front wall means;

the support shelf being spaced above the upper extent of said laterally elongated opening in the front wall means, so as to frustrate said one person from manually reaching articles on said support shelf through said opening in the front wall means of the cabinet; and said cabinet having rear wall means with a series of apertures therein located adjacent to and immediately above the support shelf, with one aperture of said series of apertures associated with each vertically elongated compartment, said aperture being sized, shaped and located such that said other person, by insertion of his finger forwardly through said aperture, will dispense only the lowest item of each stack of prepackaged articles forwardly past the forward edge of the support shelf to fall onto said discharge chute means.

* * * * *